US007523074B2

(12) United States Patent
Mattern

(10) Patent No.: US 7,523,074 B2
(45) Date of Patent: Apr. 21, 2009

(54) SYSTEM FOR DYNAMICALLY PROVIDING ADDRESS AND INDICIA INFORMATION

(75) Inventor: James M. Mattern, Bethany, CT (US)

(73) Assignee: Neopost Technologies, Bagneux (FR)

( * ) Notice: Subject to any disclaimer, the term of this patent is extended or adjusted under 35 U.S.C. 154(b) by 582 days.

(21) Appl. No.: 11/047,411

(22) Filed: Jan. 31, 2005

(65) Prior Publication Data

US 2006/0173795 A1 Aug. 3, 2006

(51) Int. Cl.
*G07B 17/00* (2006.01)

(52) U.S. Cl. ..... 705/401; 710/5; 342/350

(58) Field of Classification Search ..... 705/5, 705/401; 345/173; 710/5; 342/350
See application file for complete search history.

(56) References Cited

U.S. PATENT DOCUMENTS 5,627,517 A * 5/1997 Theimer et al. ..... 340/572.1
5,684,705 A * 11/1997 Herbert ..... 705/401
6,415,336 B1 * 7/2002 Sansone ..... 710/5
6,546,377 B1 * 4/2003 Gravell et al. ..... 705/60
6,753,830 B2 * 6/2004 Gelbman ..... 345/55
7,106,202 B2 * 9/2006 Dickinson ..... 340/572.8
2002/0138452 A1 * 9/2002 Cox ..... 705/401
2005/0134436 A1 * 6/2005 Brookner ..... 340/14.69

OTHER PUBLICATIONS

Radio Frequency (RFID) Evaluation, Commerce Business Daily, Washington: Nov. 24, 2000. Available: http://proquest.umi.com/pqdweb?index=35&did=64587088&SrchMode=1&sid=5&Fmt=3&VInst=PROD&VType=PQD&RQT=309&VName=PQD&TS= 1228757617&clientId19649.*

* cited by examiner

*Primary Examiner*—John W Hayes
*Assistant Examiner*—Kevin Flynn
(74) *Attorney, Agent, or Firm*—Townsend and Townsend and Crew LLP

(57) ABSTRACT

An intelligent label for dynamically displaying an information bearing indicium. The label includes a microprocessor coupled to communications circuitry, a display and a storage device. The storage device stores instructions that are executed by the microprocessor to receive through the communications circuitry a request for location information, to send through the communications circuitry location information in response to the request, to receive information based upon a computed postage amount, and to show on the label display an information bearing indicium based upon the computed postage amount.

20 Claims, 5 Drawing Sheets

SYSTEM FOR DYNAMICALLY PROVIDING ADDRESS AND INDICIA INFORMATION

BACKGROUND OF THE INVENTION

The disclosed embodiments relate to a postal service system that includes a label with communication and display capabilities.

BRIEF DESCRIPTION OF RELATED DEVELOPMENTS

A high volume postal customer may use a meter which incorporates a Postal Security Device (PSD) to secure the proof of payment of postal indicia. In an exemplary application, indicia may be applied to mailing items that identifies the value of the postage applied and other information. A customer may purchase postage and the purchased value may be stored in the PSD. As the postage indicia is applied to items, the value applied may be deducted from the stored value. Once postage indicia is applied, the item may then be dropped into the collection stream of the particular postal system and subsequently processed for delivery.

In various countries, for example the United States, postal meters may communicate with a remote data center to exchange information related to customer usage and funding for billing purposes and to have postage funds replenished. In the United States, a postal customer generally may add postage to the meter in two ways. The first is to physically take the meter to the postal authority, generally referred to herein as "the post," where postage is purchased and added to the PSD. The second is to remotely add postage over a network, for example, a telephone line with a modem, or the Internet, where the added postage is deducted from an account usually maintained with a meter vendor or a trusted third party administrator, for example, a financial institution. In this case, customer or postal authority access to a meter's accounting system or memory system generally is not possible. Meters with this type of communication capability may initiate communication with a host computer to add funds or to reestablish authenticity. A communication cycle may be initiated automatically, or by a user of the meter.

Generally a mail piece includes a label that is printed with address information and indicia indicating that postage for the mail piece has been paid. It would be advantageous to provide an intelligent label that is capable of downloading and displaying information that does not require the address and indicia to be determined until it is convenient for the sender.

SUMMARY OF THE EXEMPLARY EMBODIMENTS

In accordance with an exemplary embodiment, a system for dynamically providing labeling information includes a meter with a communications port, and a label operable to receive and display address and indicia information from the meter.

In accordance with another exemplary embodiment, a label for dynamically providing labeling information includes a microprocessor, communication circuitry connected to the microprocessor and a display connected to the microprocessor. The communication circuitry is operable to transmit and receive information to and from a postage meter. The display is operable to display address and indicia information received from the postage meter.

In accordance with an exemplary embodiment, a postage meter for dynamically providing labeling information includes a microprocessor and a communications port connected to the microprocessor. The communications port effecting communication with a label and a data center. The postage meter is configured to dynamically provide indicia services to the label through the communications port.

In accordance with another exemplary embodiment, a data center includes a server and communications circuitry connected to the server for communicating with a postage meter. The data center is configured to receive delivery confirmation of a mail piece from the postage meter based on location information transmitted by a label.

In accordance with an exemplary embodiment, a method for dynamically providing labeling information includes identifying, with a postage meter, any labels connected to a network, the labels being operable to transmit and receive information. The method also includes the postage meter interrogating a label to obtain a location of the label, the postage meter computing an amount of postage based on the location of the label and a destination address associated with the label, sending postage indicium information containing at least the address that is to be displayed on the label, from the postage meter to the label and displaying the postage indicium information on a display of the label.

BRIEF DESCRIPTION OF THE DRAWINGS

The foregoing aspects and other features of the disclosed embodiments are explained in the following description, taken in connection with the accompanying drawings, wherein.

DETAILED DESCRIPTION OF THE PREFERRED EMBODIMENTS

Figure 1:
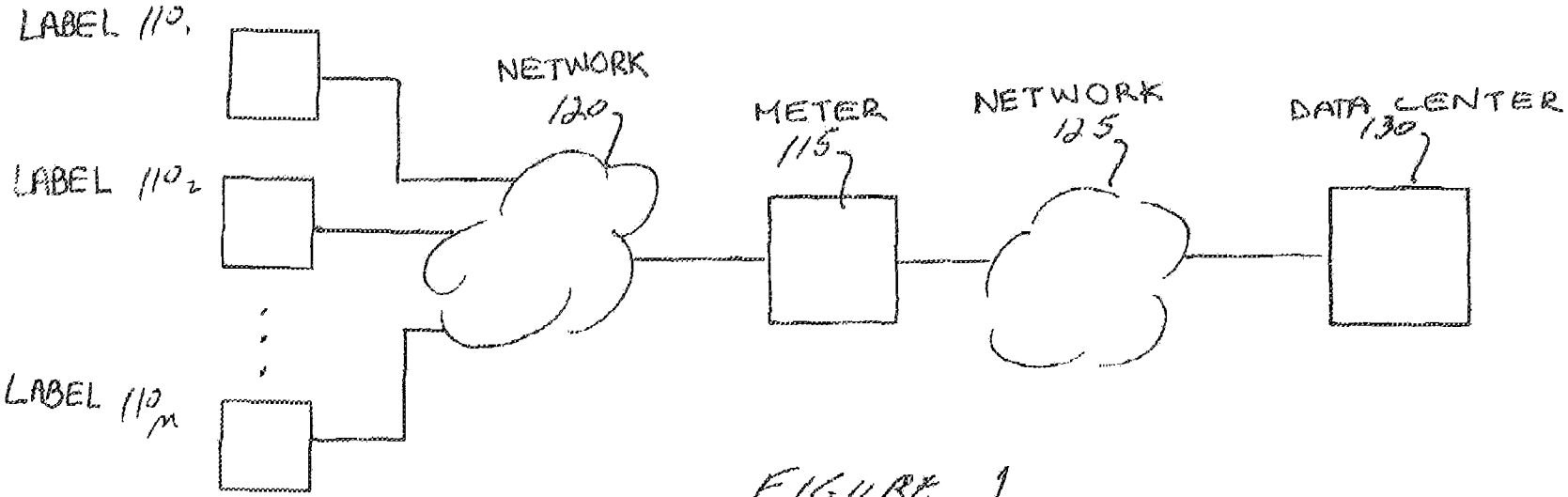
FIG. 1 shows a block diagram of a system suitable for practicing the disclosed embodiments.

FIG. 1 shows a block diagram of a system 100 suitable for practicing the disclosed embodiments disclosed herein. Although the disclosed embodiments will be described with reference to the embodiment shown in the drawings, it should be understood that the disclosed embodiments can be embodied in many alternate forms of embodiments. In addition, any suitable size, shape or type of elements or materials could be used.

System 100 includes one or more labels $\mathbf{110}_1 \ldots \mathbf{110}_n$ that communicate with a funding device, shown in FIG. 1 as a meter 115 through a first network 120. System 100 also includes a postal infrastructure data center 130 connected to the meter 115 through a second network 125.

It is a feature of the disclosed embodiments for the one or more labels to $\mathbf{110}_1 \ldots \mathbf{110}_n$ to communicate with meter 115 to receive address and indicia information. For example, one or more of the labels 110 may be applied to a number of packages. A user may enter or obtain address information through meter 115 for a particular package. The meter 115 may initiate communication with a particular label attached to the package and download information to be displayed on the label, for example, address and indicia information.

As another example, when a particular package with one of the exemplary labels is introduced or about to be introduced into a mail stream, the label may initiate communication with the meter and request address and indicia information to be displayed. Communications between the labels $\mathbf{110}_1 \ldots \mathbf{110}_n$ and the meter 115 may be wireless.

Figure 2:
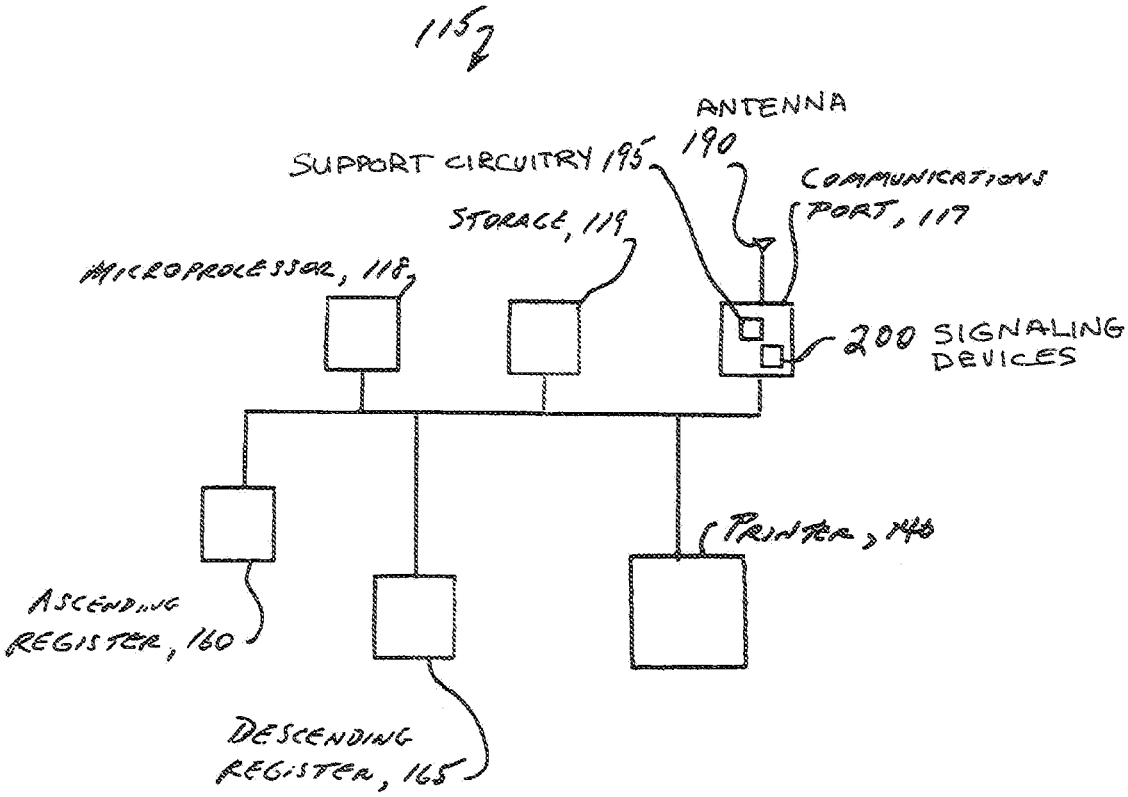
FIG. 2 shows a block diagram of meter according to the disclosed embodiments.

FIG. 2 shows a general block diagram of meter 115. Meter 115 may include a communications port 117 and a microprocessor 118 for performing electronic accounting functions, control functions, and franking functions according to programs stored in a storage device 119. Some of these functions or subsets of these functions may be grouped within a secure perimeter as what is commonly referred to as a Postal Security Device (PSD).

Storage device 119 generally stores machine readable program code which is adapted to cause microprocessor 118 to perform the functions of the disclosed embodiments. Storage device 119 may utilize optical, magnetic, semiconductor, electronic, or other types of suitable devices to store the program code.

Microprocessor 118 typically performs the electronic accounting functions in relation to franking items. Data associated with the accounting functions may include an accumulated total value of credit entered into the PSD, an accumulated total value of charges dispensed by the PSD by franking items, a count of the number of items franked, and a count of the number of items franked with a charge in excess of a predetermined value. The accumulated total value of credit may be stored in an ascending credit register 160, the accumulated total value of postage charges dispensed may be stored in a descending register 165, and the count of items may be stored in an items count register 170. The various registers may be located in storage device 119.

The franking functions performed by microprocessor 118 typically include providing labels $\mathbf{110}_1 \ldots \mathbf{110}_n$ with address information, indicia information and other information, and reporting the number of items, value marked and other parameters to the accounting functions. Such address information, indicia information and other information are referred to herein as indicia services.

The meter 115 may also provide indicia services locally utilizing a printer 140 and may be capable of franking a label, directly franking a mail piece, or franking any other suitable substrate. Meter 115 may be capable of printing stamps, barcodes, addresses, planet codes, images, text, indicia, logos, graphics, or any other printable item in any desired order.

The control functions performed by microprocessor 118 may include utilizing communications port 117 to communicate with and provide indicia services to the one or more labels $\mathbf{110}_1 \ldots \mathbf{110}_n$. Communications port 117 generally includes an antenna 190 and support circuitry 195 or other signaling devices 200 for communicating with the labels $\mathbf{110}_1 \ldots \mathbf{110}_n$. The signaling devices 200 may utilize first network 120 to provide an air interface, a wired interface, a wireless interface, or an electrical, electromagnetic, radio, infrared, or other suitable facility for communicating with labels $\mathbf{110}_1 \ldots \mathbf{110}_n$. The support circuitry 195 may also include location determining circuitry, for example, a GPS facility for determining the location of the meter 115.

The control functions may further include utilizing communications port 117 for communication with the postal infrastructure data center 130 through the second communication network 125. The antenna 190 and support circuitry 195, as well as the other signaling devices 200 may support such communication in a manner similar to the communication provided with labels $\mathbf{110}_1 \ldots \mathbf{110}_n$ through first network 120.

The provision of indicia services is performed by microprocessor 118 under the control of programs located in storage device 119.

As another feature of the disclosed embodiments, meter 115 may identify that one or more of the labels $\mathbf{110}_1 \ldots \mathbf{110}_n$ is capable of communicating with meter 115. For example, meter 115 may attempt to identify any labels $\mathbf{110}_1 \ldots \mathbf{110}_n$ connected to network 120, for example by polling network addresses or other identification techniques (Block 501, FIG. 5). Meter 115 may also attempt to identify labels by broadcasting a paging signal or other type of signal that requests a response.

First network 120 may include any suitable communications network, for example, the Public Switched Telephone Network (PSTN), a wireless network, a wired network, a Local Area Network (LAN), a Wide Area Network (WAN), virtual private network (VPN), air interface, etc. The air interface may include any suitable wireless communication protocol or signaling techniques or standards, for example TDMA, CDMA, IEEE 802.11, Bluetooth, close range RF, optical, any appropriate satellite communication standards, etc.

After a connection has been established, one or more of the labels $\mathbf{110}_1 \ldots \mathbf{110}_n$ may utilize meter 115 for indicia services. As mentioned above, the meter 115 generally provides a label with address and indicia information for display by the label 110.

These functions and selections may include purchasing postage, purchasing admission to one or more events, purchasing merchandise or services, or otherwise producing indicia that has value.

As another feature of the disclosed embodiments, meter 115 may have the capability to access the postal infrastructure data center 130 to download updates or additional service capability as desired. For example, meter 115 may access the postal infrastructure data center 130 to provide delivery confirmation for specific mail pieces.

Returning to FIG. 1, as mentioned above, meter 115 communicates with the postal infrastructure data center 130 through the second communication network 125. Second communication network 125 may include any suitable communications network, for example, the Public Switched Telephone Network (PSTN), a wireless network, a wired network, a Local Area Network (LAN), a Wide Area Network (WAN), virtual private network (VPN), an air interface, etc. The air interface may include any suitable wireless communication protocols or signaling techniques or standards, for example TDMA, ODMA, IEEE 802.11, Bluetooth, close range RF, optical, any appropriate satellite communication standards, etc. In one embodiment, the first communication network 120 may be the same as the second communication network 125.

Figure 4:
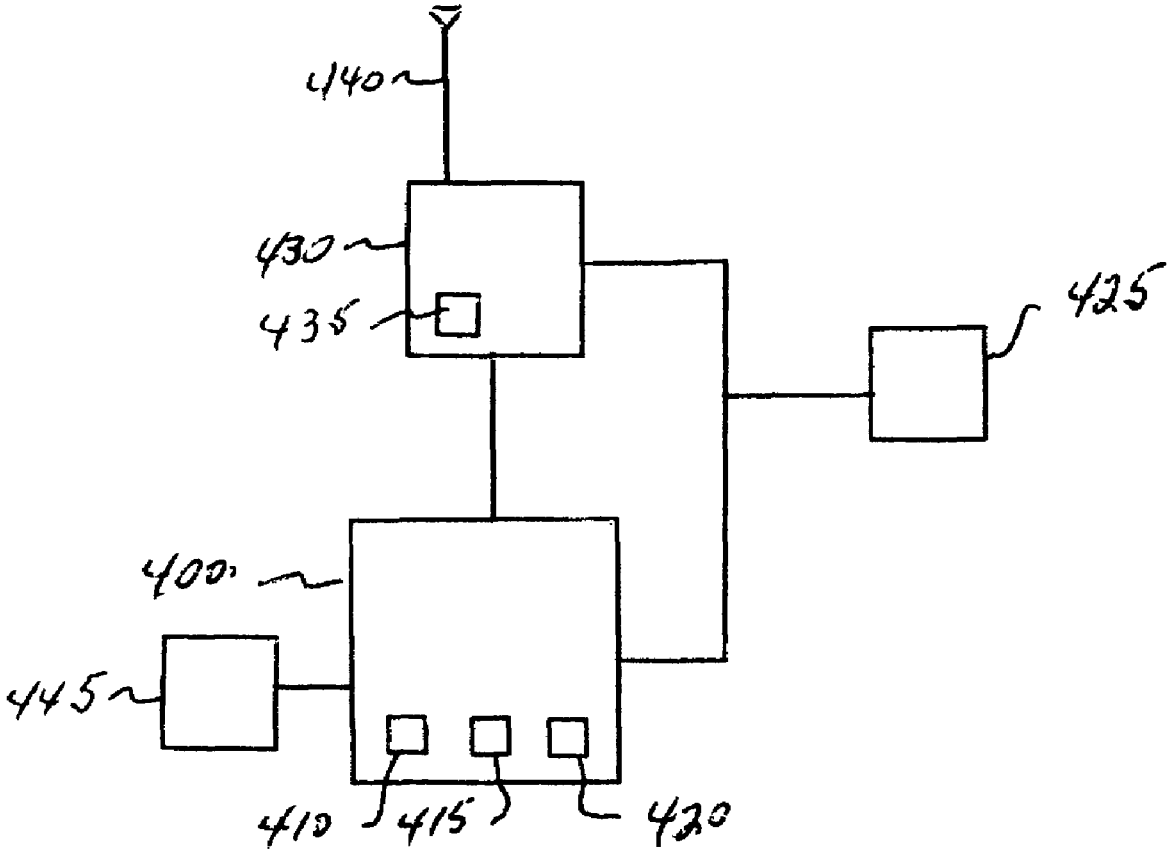
FIG. 4 shows a diagram of a postage infrastructure data center.

Referring to FIG. 4, the postal infrastructure data center 130 may generally include a server 400, several data bases 410, 415, 420, a power facility 425, for example, a power distribution network, and communication circuitry 430. Communication circuitry 430 may include an antenna 440 and other circuitry and devices 435 for communication with meter 115 through the second network 125.

In other embodiments, devices 435 may include suitable circuitry, programs, transmitters and receivers for any appropriate type of wireless communication utilizing radio frequency (RF), infrared (IR), optical, acoustical, any type of electromagnetic based technology, or any other type of wireless communication. The postal infrastructure data center 130 may also include a user interface facility 445 which may provide local users with access to postal infrastructure data center services.

Figure 3:
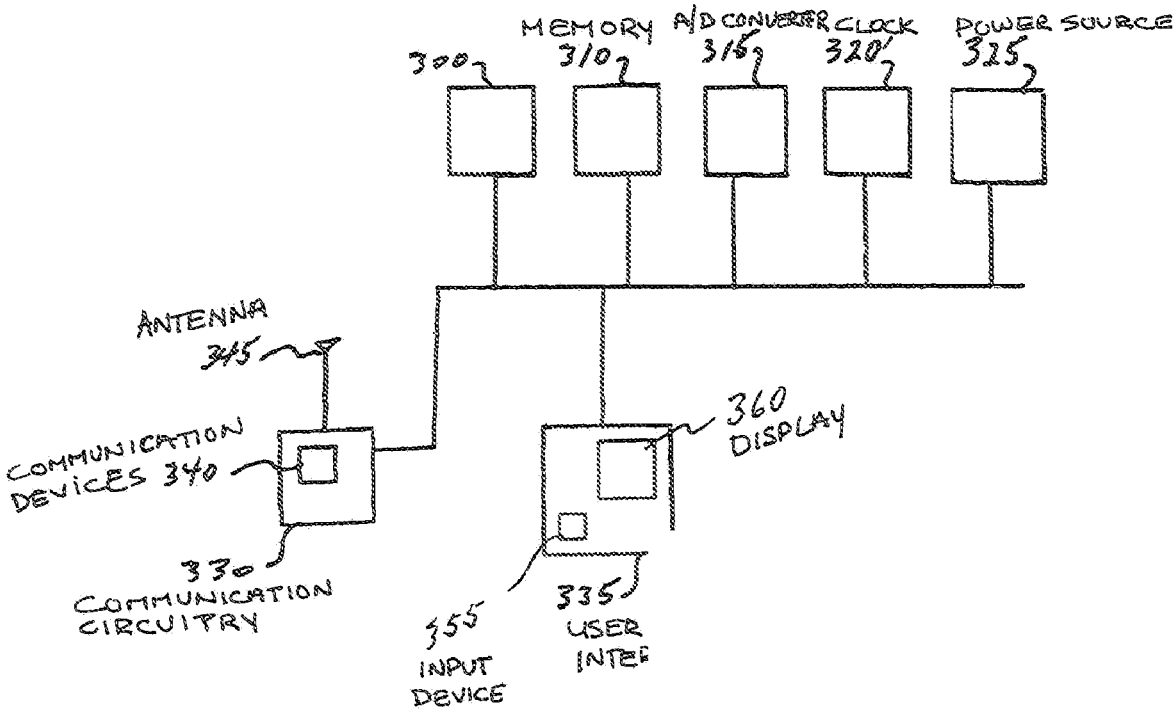
FIG. 3 shows a diagram of a label with display and communication capabilities according to the disclosed embodiments.

Referring to FIG. 3, the label 110 may generally include a microprocessor 300, on-board memory 310, an analog to digital converter 315, a real time clock interrupt controller 320, a power source 325, for example, a battery, and communication circuitry 330. Communication circuitry 330 may include an antenna 345 and other circuitry and devices 340 for wireless communication with meter 115. In other embodiments, devices 340 may include suitable circuitry, programs, transmitters and receivers for any appropriate type of wireless communication utilizing radio frequency (RF), infrared (IR), optical, acoustical, any type of electromagnetic based technology, or any other type of wireless communication. The devices 340 may also include location determining circuitry, for example a GPS facility, for determining the location of the label 110.

The microprocessor 300 may operate under the control of programs found in the on board memory 310. The on board memory 310 may provide storage information associated with the operation of the label 110. The on board memory 310 may be configured as a non-volatile memory which retains its contents in the event of a power loss.

The label 110 generally includes a user interface 335 that may include an input device 355, for example a button, keypad, or other input device, and a display 360 which may utilize liquid crystal, plasma, or any other appropriate display technology. The label 110 is generally able to display postage, ticket allowing admission to one or more events, stamps, barcodes, addresses, planet codes, images, text, indicia, logos, graphics, or any other displayable item, either alone or in combination.

As another feature of the disclosed embodiments, meter 115 may download indicia information specific to a location from which a mail piece bearing the label 110 is to be placed into a postal service collection point.

Figure 5:
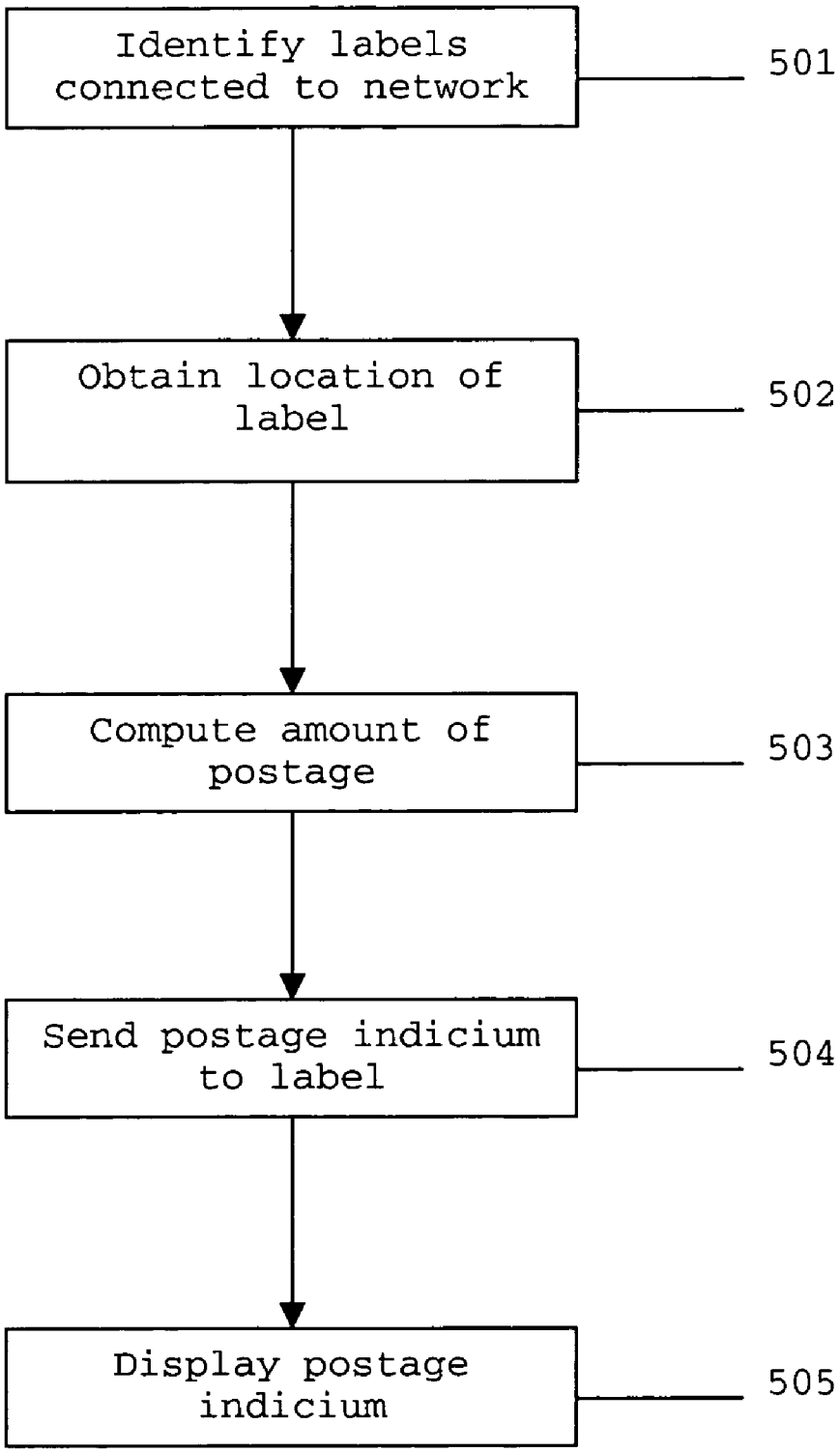
FIG. 5 shows a flow diagram in accordance with a method of an exemplary embodiment.

In this aspect of the disclosed embodiments, when communication is established between the label 100 and the meter 115, the meter may interrogate the label as to its location, for example by requesting location information from devices 340 (Block 502, FIG. 5). Upon receiving the location information, meter may compute indicia information or postage based on the address that is to be displayed on the label and the present location of the label and download the information to the label to be displayed (Blocks 503-505, FIG. 5).

For example, a user in the vicinity of a postal service collection point may operate the user interface to indicate that a mail piece bearing the label 110 is about to be deposited in a mail stream. A connection is established between the label 110 and the meter 115 as described above. The meter determines the location of the label 110 and then may determine which post office or postal system services that location, and may provide appropriate indicia information to the label 110.

It should be understood that the foregoing description is only illustrative of the disclosed embodiments. Various alternatives and modifications can be devised by those skilled in the art without departing from the disclosed embodiments. Accordingly, the disclosed embodiments is intended to embrace all such alternatives, modifications and variances which fall within the scope of the appended claims.

What is claimed is:

1. A method for forming an indicium, comprising sending to a label a request for location information;

the label determining a location information of the label;

receiving the location information from the label;

computing a postage amount based at least partly upon the location information and a destination address associated with the label; and sending postage information to the label based upon the computed postage amount.

2. The method of claim 1, further comprising displaying on the label an indicum that bears the value of the computed postage amount.

3. The method of claim 1, further comprising sending destination address information to the label.

4. The method of claim 1, wherein information associated with the destination address is received from the label.

5. The method of claim 1, wherein the postage information comprises an information bearing indicium.

6. The method of claim 1, further comprising sending to the label an instruction to display an indicium.

7. The method of claim 1, further comprising sending to a data center a delivery confirmation signal for a mailpiece associated with the label.

8. The method of claim 1, further comprising sending information pertaining to the postal service collection point at which a mailpiece associated with the label is deposited.

9. A postage meter, comprising:

a microprocessor;

communications circuitry coupled to the microprocessor; and a storage device coupled to the microprocessor, the storage device storing instructions adapted to be executed by the microprocessor to send through the communications circuitry a request for information to a label, receive location information, determined by the label, from the label in response to the request, detect a destination address associated with the label, compute a postage amount based at least partly upon the received location information and the detected destination address and to send to the label through the communications circuitry information based upon the computed postage amount.

10. The postage meter of claim 9, wherein the microprocessor sends destination address information through the communications circuitry to the label.

11. The postage meter of claim 9, wherein the microprocessor receives destination address information from the label.

12. The postage meter of claim 9, wherein the microprocessor forms an information bearing indicium based upon the computed postage and sends to the label the information bearing indicium through the communications circuitry.

13. The postage meter of claim 9, wherein the microprocessor sends an instruction to display an indicium to the label through the communications circuitry.

14. The postage meter of claim 9, wherein the microprocessor sends a delivery confirmation signal for a mailpiece associated with the label to a data center through the communications circuitry.

15. The postage meter of claim 9, wherein the microprocessor sends information pertaining to the postal service collection point at which a mailpiece associated with the label is deposited through the communications circuitry.

16. A label, comprising:

a microprocessor;

communications circuitry coupled to the microprocessor;

a display coupled to the microprocessor; and a storage device coupled to the microprocessor, the storage device storing instructions adapted to be executed by the microprocessor to receive through the communications circuitry a request for location information, to send through the communications circuitry location information determined by the label in response to the request, to receive information based upon a computed postage amount, and to show on the display an information bearing indicium based upon the computed postage amount.

17. The label of claim 16, wherein the microprocessor receives address information for a mailpiece associated with the label through the communications circuitry destination.

18. The label of claim 16, wherein the microprocessor receives an instruction to display the information bearing indicium through the communications circuitry.

19. The label of claim 16, wherein the microprocessor sends a delivery confirmation signal for a mailpiece associated with the label through the communications circuitry.

20. The label of claim 16, wherein the microprocessor sends a signal including information pertaining to the postal service collection point at which a mailpiece associated with the label is deposited through the communications circuitry.

* * * * *